US009328925B2

(12) United States Patent
Vandale

(10) Patent No.: US 9,328,925 B2
(45) Date of Patent: May 3, 2016

(54) CROSS-FIRE TUBE PURGING ARRANGEMENT AND METHOD OF PURGING A CROSS-FIRE TUBE

(71) Applicant: General Electric Company, Schenectady, NY (US)

(72) Inventor: Daniel Doyle Vandale, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 647 days.

(21) Appl. No.: 13/677,960

(22) Filed: Nov. 15, 2012

(65) Prior Publication Data

US 2014/0130505 A1 May 15, 2014

(51) Int. Cl.
*F23R 3/48* (2006.01)

(52) U.S. Cl.
CPC ..... *F23R 3/48* (2013.01)

(58) Field of Classification Search
CPC ..... F23R 3/48; F23R 3/46; F23R 3/286; F23R 2900/03041; F23R 2900/03042; F23D 2209/30; F02C 7/26–7/264; F23N 2027/00–2027/06
See application file for complete search history.

(56) References Cited

U.S. PATENT DOCUMENTS 3,001,366 A * 9/1961 Shutts ..... 60/39.821
3,650,106 A * 3/1972 Guillot ..... 60/748
3,811,274 A * 5/1974 Calderon ..... 60/800
4,249,372 A * 2/1981 White ..... 60/796
5,001,896 A * 3/1991 Hilt et al. ..... 60/800
5,265,413 A * 11/1993 Cannon et al. ..... 60/800
5,361,577 A 11/1994 Cromer
5,402,635 A * 4/1995 Smith et al. ..... 60/39.37
5,749,218 A * 5/1998 Cromer ..... B23P 6/002 60/39.37
5,896,742 A * 4/1999 Black et al. ..... 60/39.37
6,220,015 B1 * 4/2001 Mina ..... 60/39.37
6,334,294 B1 * 1/2002 Belsom et al. ..... 60/772
6,705,088 B2 * 3/2004 Martling et al. ..... 60/800
6,912,838 B2 * 7/2005 Sileo et al. ..... 60/39.37
7,284,378 B2 * 10/2007 Amond et al. ..... 60/776
7,891,192 B2 * 2/2011 Myers et al. ..... 60/741
7,966,820 B2 * 6/2011 Romoser ..... 60/742
8,109,099 B2 * 2/2012 Tu et al. ..... 60/759
8,220,246 B2 * 7/2012 Widener ..... 60/39.37
8,893,501 B2 * 11/2014 Antoniono et al. ..... 60/752
8,925,328 B2 * 1/2015 Rodd et al. ..... 60/778
2010/0162724 A1 * 7/2010 Myers ..... F23N 5/00 60/794
2012/0247118 A1 * 10/2012 Antoniono et al. ..... 60/773

* cited by examiner

*Primary Examiner* — William H Rodriguez
*Assistant Examiner* — Jason H Duger
(74) *Attorney, Agent, or Firm* — Dority & Manning, PA

(57) ABSTRACT

A cross-fire tube purging arrangement includes a cross-fire tube extending from proximate a combustor chamber to proximate an adjacent combustor chamber for fluidly coupling the combustor chamber and the adjacent combustor chamber. Also included is a compressed air supply arrangement for selectively delivering a compressed air to the cross-fire tube, the compressed air supply arrangement comprising a regulating component for controlling delivery of the compressed air to the cross-fire tube.

20 Claims, 3 Drawing Sheets

CROSS-FIRE TUBE PURGING ARRANGEMENT AND METHOD OF PURGING A CROSS-FIRE TUBE

BACKGROUND OF THE INVENTION

The subject matter disclosed herein relates to turbine systems, and more particularly to a cross-fire tube purging arrangement, as well as a method of purging a cross-fire tube.

Adjacent combustors of a gas turbine engine are typically connected by cross fire tubes to ensure substantially simultaneous ignition and equalized pressure in all combustor chambers of the gas turbine engine. It is common for less than all of the combustor chambers to include an ignition component to initiate a flame. In such an arrangement, the cross-fire tube allows a flame to pass from one combustor chamber to an adjacent combustor chamber. The cross-fire tubes may also be required to pass the flame from lighted to unlighted premixing regions of the combustor chambers during a light-off operating condition between a premix operating condition and a steady state operating condition. In the premix condition, the region of the combustor chamber connected by cross-fire tubes has no flame and is used for premixing the fuel and air, while in the light-off operating condition this same region has a flame.

When the cross-fire tubes are not in use, they must resist the unwanted passage of either hot gases from combustion or unburned fuel in the premixing zone from adjoining combustor chambers, which may lead to melting of the cross-fire tube or re-ignition of the premix zone of combustion. Resistance may be imposed by introducing a purge air to the cross-fire tube, however, constant purging is not desirable during all operating conditions, such as during ignition that leads to the light-off condition which requires passage of the flame from one combustor chamber to another.

BRIEF DESCRIPTION OF THE INVENTION

According to one aspect of the invention, a cross-fire tube purging arrangement includes a cross-fire tube extending from proximate a combustor chamber to proximate an adjacent combustor chamber for fluidly coupling the combustor chamber and the adjacent combustor chamber. Also included is a compressed air supply arrangement for selectively delivering a compressed air to the cross-fire tube, the compressed air supply arrangement comprising a regulating component for controlling delivery of the compressed air to the cross-fire tube.

According to another aspect of the invention, a cross-fire tube purging arrangement includes a cross-fire tube comprising a first portion and a second portion operably coupled to each other and surrounded by a tube casing. Also included is a compressed air supply arrangement comprising one or more pipes extending through the tube casing into close proximity with an annular manifold disposed along a portion of the cross-fire tube. Further included is a regulating component in communication with the compressed air supply arrangement for controlling delivery of a compressed air to the annular manifold, wherein the compressed air is delivered to the annular manifold during a first operating condition and restricted during a second operating condition.

According to yet another aspect of the invention, a method of purging a cross-fire tube is provided. The method includes delivering a compressed air to the cross-fire tube during a first operating condition for purging the cross-fire tube. Also included is restricting a flow of the compressed air to the cross-fire tube during a second operating condition.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
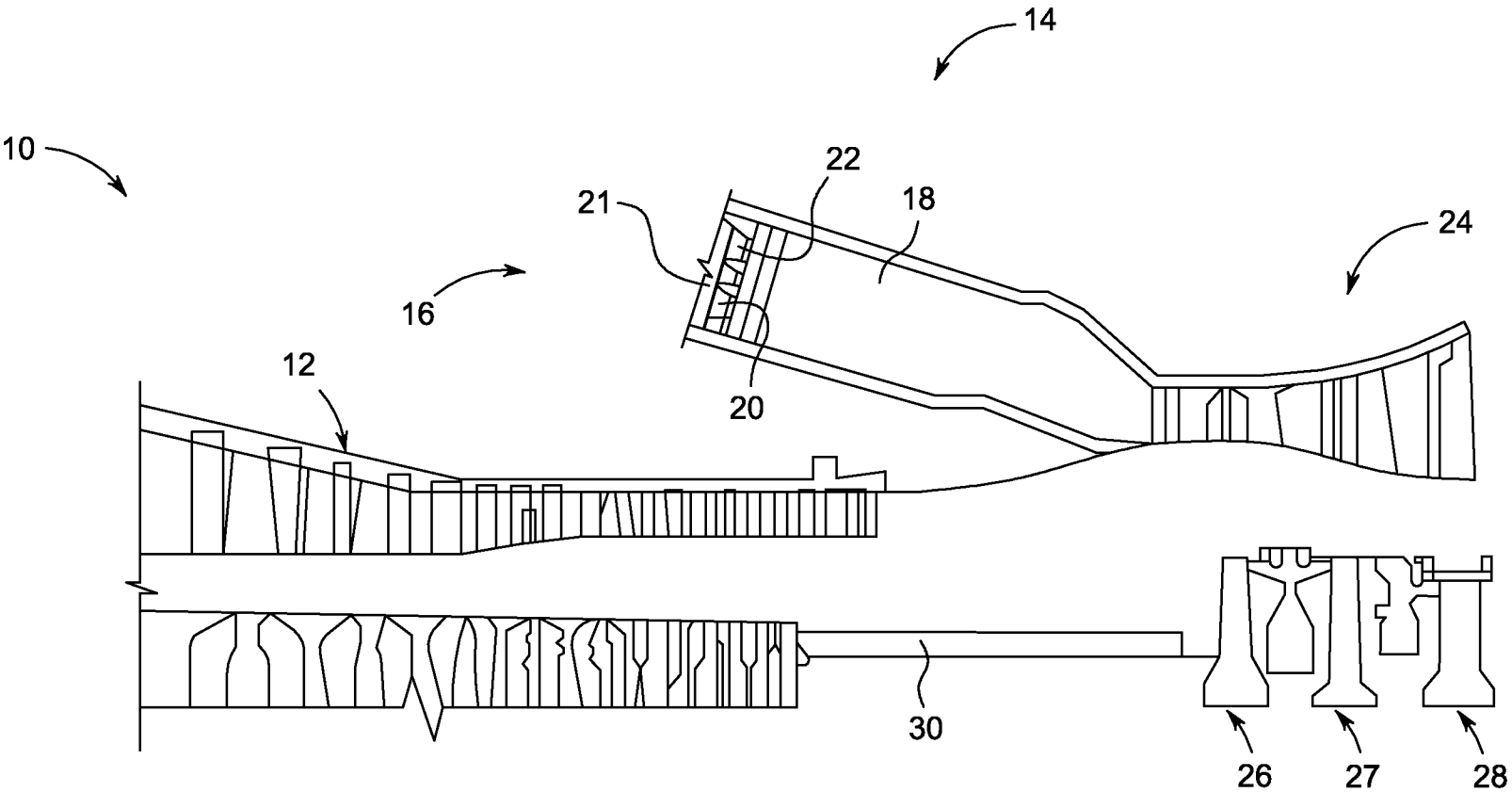
FIG. 1 is a schematic illustration of a gas turbine system.

Referring to FIG. 1, a gas turbine engine 10 constructed in accordance with an exemplary embodiment of the present invention is schematically illustrated. The gas turbine engine 10 includes a compressor 12 and a plurality of combustor assemblies arranged in a can annular array, one of which is indicated at 14. As shown, the combustor assembly 14 includes an endcover assembly 16 that seals, and at least partially defines, a combustor chamber 18. A plurality of nozzles 20-22 are supported by the endcover assembly 16 and extend into the combustor chamber 18. The nozzles 20-22 receive fuel through a common fuel inlet (not shown) and compressed air from the compressor 12. The fuel and compressed air are passed into the combustor chamber 18 and ignited to form a high temperature, high pressure combustion product or air stream that is used to drive a turbine 24. The turbine 24 includes a plurality of stages 26-28 that are operationally connected to the compressor 12 through a compressor/turbine shaft 30 (also referred to as a rotor).

In operation, air flows into the compressor 12 and is compressed into a high pressure gas. The high pressure gas is supplied to the combustor assembly 14 and mixed with fuel, for example natural gas, fuel oil, process gas and/or synthetic gas (syngas), in the combustor chamber 18. The fuel/air or combustible mixture ignites to form a high pressure, high temperature combustion gas stream. In any event, the combustor assembly 14 channels the combustion gas stream to the turbine 24 which converts thermal energy to mechanical, rotational energy.

Figure 2:
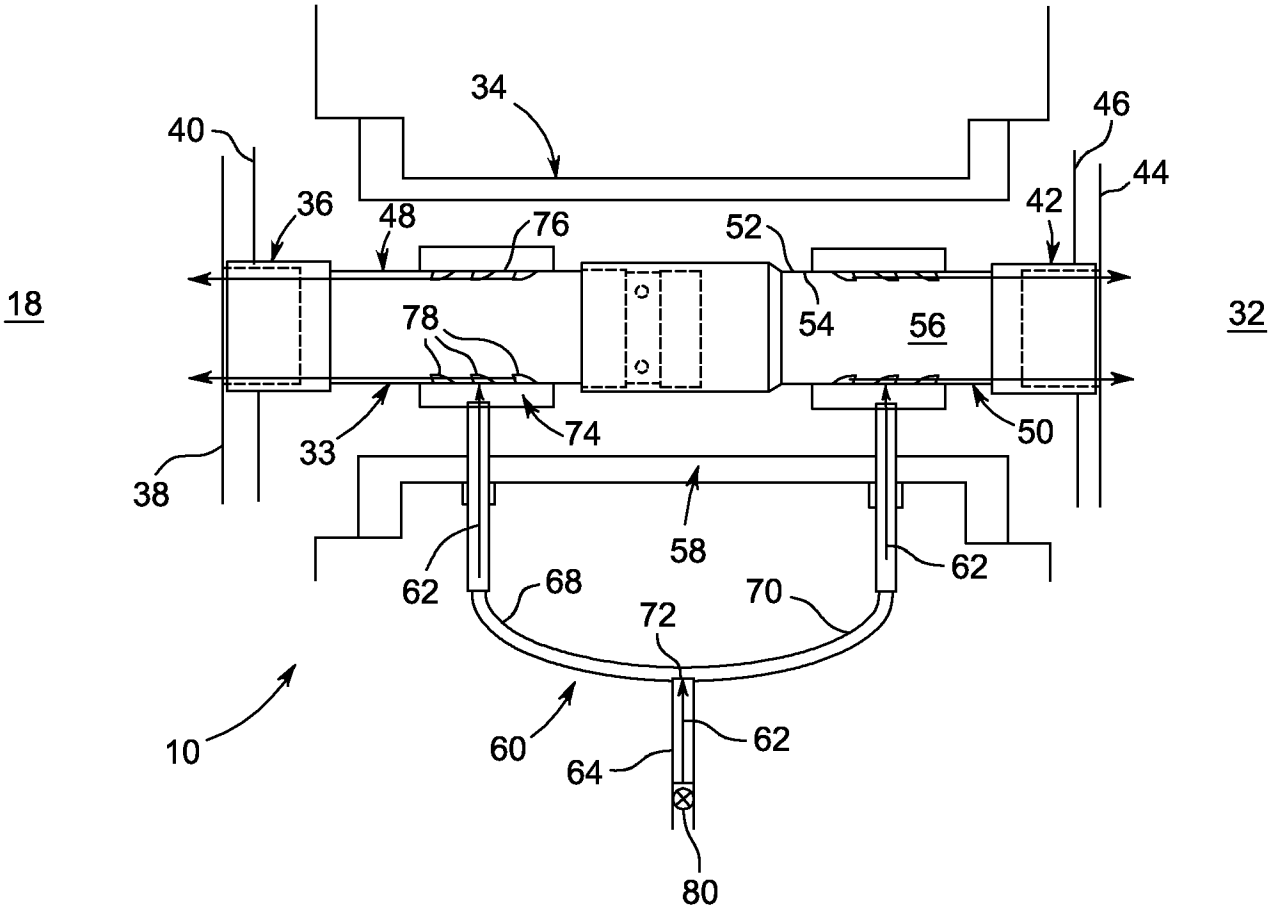
FIG. 2 is a schematic illustration of a cross-fire tube purging arrangement of the gas turbine system.

Referring now to FIG. 2, as noted above, a can annular array of combustor assemblies is arranged in a circumferentially spaced manner about an axial centerline of the gas turbine engine 10. For illustration clarity, a partial view of the can annular array is shown and includes the combustor chamber 18 and an adjacent combustor chamber 32. The combustor chamber 18 and the adjacent combustor chamber 32 are fluidly coupled with a cross-fire tube 33 of a cross-fire tube arrangement 34, with the cross-fire tube 33 fixed at a first end 36 proximate a combustor liner 38 and/or a sleeve 40 that surrounds the combustor liner 38. The cross-fire tube 33 is fixed at a second end 42 proximate an adjacent combustor liner 44 and/or an adjacent sleeve 46 that surrounds the adjacent combustor liner 44. The cross-fire tube 33 typically includes a first portion 48 and a second portion 50 that are operably coupled to each other. In one embodiment, the first portion 48 is referred to as a male portion that is telescopingly engaged with the second portion 50 that is referred to as a female portion for receiving the first portion 48.

The cross-fire tube 33 includes an outer surface 52 and an inner surface 54, with the inner surface 54 defining an interior region 56 that provides the fluid coupling of the combustor chamber 18 and the adjacent combustor chamber 32, which allows the passage of a flame from the combustor chamber 18 to the adjacent combustor chamber 32, or vice versa. Such passage is desirable during light-off of the combustor assemblies of the gas turbine engine 10 and allows for nearly simultaneous ignition or re-ignition of the combustor assemblies.

The cross-fire tube arrangement 34 also includes a tube casing 58 that is spaced radially outwardly of the cross-fire tube 33 and may assist with supporting the cross-fire tube 33, however, fixing of the first end 36 and the second end 42 may be sufficient for supporting purposes. Both the cross-fire tube 33 and the tube casing 58 are made of a material sufficient to withstand the temperatures imposed on the materials during operation of the gas turbine engine 10 and typically include a metal having a melting temperature high enough to function during high temperature operation.

A compressed air supply arrangement 60 comprises a piping or tubing configuration for routing and delivering a compressed air 62 from the compressor 12, typically indirectly from the compressor 12 via a compressor discharge casing region (not illustrated), to the cross-fire tube 33. The piping or tubing configuration of the compressed air supply arrangement 60 may be arranged in numerous configurations, with the illustrated configuration merely a single example. As shown, the compressed air supply arrangement 60 includes a main supply line 64 that routes the compressed air 62 from the compressor 12, or the compressor discharge casing region, to a location proximate the cross-fire tube arrangement 34, and more particularly proximate the tube casing 58. The compressed air supply arrangement 60 may be split to deliver the compressed air 62 to a plurality of locations and in one exemplary embodiment a first line 68 and a second line 70 receive the compressed air 62 from the main supply line 64 for routing to distinct locations. It is to be appreciated that additional lines may be employed for delivery of the compressed air 62 to additional locations. Additionally, a single line comprising the main supply line 64, or simply an extension thereof, may be employed to deliver the compressed air 62 to a single location.

Irrespective of the precise configuration of the compressed air supply arrangement 60, one or more of the lines extend through the tube casing 58 to a location proximate the cross-fire tube 33 for delivery of the compressed air 62. In the illustrated embodiment, the first line 68 and the second line 70 meet with the main supply line 64 at a junction 72 located externally to the tube casing 58, however, an alternate embodiment includes the junction 72 between the tube casing 58 and the cross-fire tube 33. The compressed air supply arrangement 60 delivers the compressed air 62 to an annular manifold 74 that extends circumferentially around the cross-fire tube 33 to achieve a relatively even flow distribution of the compressed air 62 to the interior region 56 for purging of fluid out of the cross-fire tube 33. The annular manifold 74 may include one or more angled injectors 76 for directing the compressed air 62 into close proximity with the inner surface 54 of the cross-fire tube 33. Directing the compressed air 62 along the inner surface 54 enhances purging since any fluid will be concentrated on the inner surface 54. Alternatively, or in combination with the one or more angled injectors 76, at least one baffle 78 may be disposed along the cross-fire tube 33 proximate the annular manifold 74 to redirect the compressed air 62 into close proximity with the inner surface 54.

In the illustrated embodiment, the first line 68 delivers the compressed air 62 to a location along the first portion 48 of the cross-fire tube 33, while the second line 70 delivers the compressed air 62 to a location along the second portion 50. It is to be appreciated that both locations include the annular manifold 74, such that a repetitive description of the annular manifold 74 for each location is not necessary.

The compressed air supply arrangement 60 includes a regulating component 80 for actively controlling a flow rate of the compressed air 62 being supplied to the cross-fire tube 33. Specifically, the regulating component 80 is configured to selectively deliver the compressed air 62 during one or more operating conditions, while restricting or halting flow of the compressed air 62 to the cross-fire tube 33 in other operating conditions. The regulating component 80 comprises any suitable metering component capable of allowing, restricting and halting flow of the compressed air 62, such as a valve, for example. The regulating component 80 may be disposed in the main supply line 64 to control flow throughout all downstream regions of the compressed air supply arrangement 60, including various lines such as the first line 68 and the second line 70. Alternatively, a plurality of regulating components may be disposed in distinct lines to provide control of each line.

Restricting or completely halting the compressed air 62 is imposed when the passage of fluid or a flame throughout the cross-fire tube 33 is desired. Such a condition exists during light-off or re-ignition of the combustor chamber 18 and the adjacent combustor chamber 32. Delivery of the compressed air 62 during such an operating condition would inhibit the ability of the combustion system to fully light-off, such that active control advantageously allows shut-off of purging during this condition. Delivery of the compressed air 62 is advantageous during steady-state operation and during a premix operating condition, for example. In the case of the premix operating condition, purging of the cross-fire tube 33 enables reliable and efficient operation of a combustion system on liquid fuel (e.g., oil fuel) operation, which reduces the need for water to suppress NOx emissions.

Figure 3:
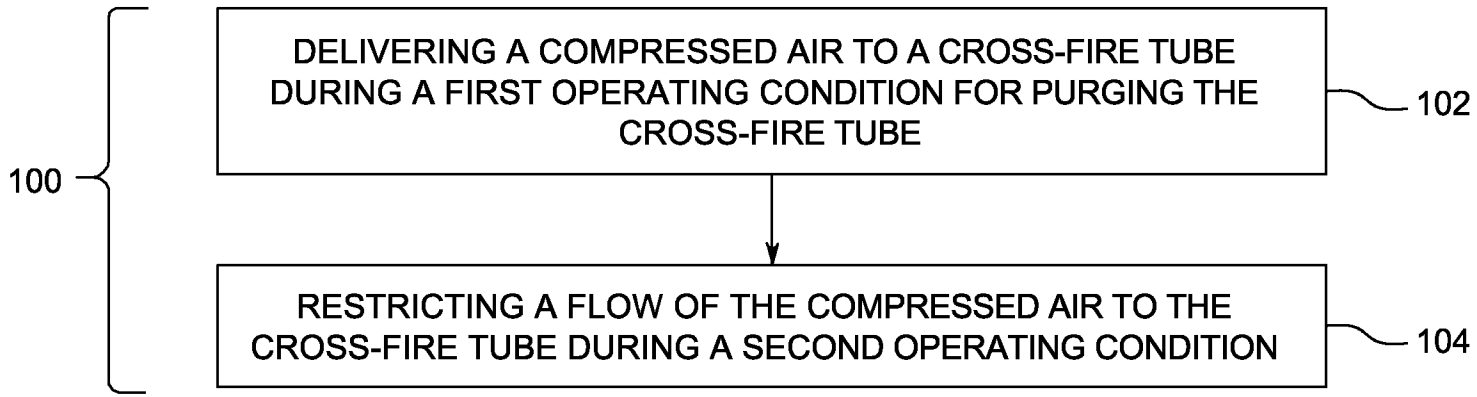
FIG. 3 is a flow diagram illustrating a method of purging a cross fire tube.

As illustrated in the flow diagram of FIG. 3, and with reference to FIGS. 1 and 2, a method of purging a cross-fire tube 100 is also provided. The gas turbine engine 10, as well as the cross-fire tube arrangement 34 and the compressed air supply arrangement 60 have been previously described and specific structural components need not be described in further detail. The method of purging a cross-fire tube 100 includes delivering a compressed air to a cross-fire tube during a first operating condition for purging the cross-fire tube 102 and restricting a flow of the compressed air to the cross-fire tube during a second operating condition 104. More specifically, the compressed air 62 is delivered to the annular manifold 74 and the restriction of the compressed air 62 is controlled with the regulating component 80, such as a valve.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A cross-fire tube purging arrangement comprising:

a cross-fire tube extending from proximate a combustor chamber to proximate an adjacent combustor chamber for fluidly coupling the combustor chamber and the adjacent combustor chamber, the cross-fire tube including a first portion and a second portion; and a compressed air supply arrangement for selectively delivering a flow of compressed air to the cross-fire tube, the compressed air supply arrangement comprising a first line for delivering a first portion of the flow of compressed air to a first annular manifold extending circumferentially around the first portion of the cross-fire tube, a second line for delivering a second portion of the flow of compressed air to a second annular manifold extending circumferentially around the second portion of the cross-fire tube, a regulating component for controlling delivery of the flow of compressed air to the first annular manifold and the second annular manifold, the regulating component positioned within the flow of compressed air upstream of the first annular manifold and the second annular manifold.

2. The cross-fire tube purging arrangement of claim 1, further comprising a tube casing spaced outwardly from, and surrounding, the cross-fire tube.

3. The cross-fire tube purging arrangement of claim 2, wherein the compressed air supply arrangement extends through the tube casing to a location proximate first annular manifold for delivering the first portion of the flow of compressed air to the first annular manifold.

4. The cross-fire tube purging arrangement of claim 2, wherein the compressed air supply arrangement extends through the tube casing to a location proximate the second annular manifold disposed proximate the second portion of the cross-fire tube for delivering the second portion of the flow of compressed air to an interior region of the cross-fire tube.

5. The cross-fire tube purging arrangement of claim 1, wherein the first annular manifold comprises at least one angled injection aperture for directing the first portion of the flow of compressed air along an inner surface of the cross-fire tube, and wherein the second annular manifold comprises at least one angled injection aperture for directing the second portion of the flow of compressed air along the inner surface of the cross-fire tube.

6. The cross-fire tube purging arrangement of claim 1, further comprising at least one redirecting component for directing the flow of compressed air along an inner surface of the cross-fire tube.

7. The cross-fire tube purging arrangement of claim 1, wherein the compressed air supply arrangement delivers the flow of compressed air to a plurality of locations proximate the cross-fire tube.

8. The cross-fire tube purging arrangement of claim 1, wherein the first portion and the second portion of the cross-fire tube are operably coupled.

9. The cross-fire tube purging arrangement of claim 1, wherein the regulating component comprises a valve, the compressed air supply arrangement configured to deliver the flow of compressed air during a first operating condition and to restrict the flow of compressed air during a second operating condition.

10. The cross-fire tube purging arrangement of claim 9, wherein the first operating condition comprises a steady-state condition and the second operating condition comprises a light-off condition.

11. The cross-fire tube purging arrangement of claim 9, wherein the first operating condition comprises a fuel-air premixing condition.

12. A cross-fire tube purging arrangement comprising:

a cross-fire tube comprising a first portion and a second portion operably coupled to each other;

a tube casing surrounding the first portion and the second portion of the cross-fire tube;

a compressed air supply arrangement comprising at least one annular manifold extending circumferentially around one of the first portion or the second portion of the cross-fire tube, and a plurality of pipes extending through the tube casing, one of the plurality of pipes extending to the at least one annular manifold to deliver a flow of compressed air to the at least one annular manifold, wherein the plurality of pipes are connected with a main supply line that routes the flow of compressed air to the compressed air supply arrangement; and a regulating component disposed in the main supply line upstream of the at least one annular manifold, the regulating component allowing the flow of compressed air to be delivered to the at least one annular manifold during a first operating condition, the regulating component restricting the flow of compressed air to the at least one annular manifold during a second operating condition.

13. The cross-fire tube purging arrangement of claim 12, wherein the at least one annular manifold comprises at least one angled injection aperture for directing the flow of compressed air along an inner surface of the cross-fire tube.

14. The cross-fire tube purging arrangement of claim 12, further comprising at least one baffle disposed along the cross-fire tube proximate the at least one annular manifold for directing the flow of compressed air along an inner surface of the cross-fire tube.

15. The cross-fire tube purging arrangement of claim 12, wherein the at least one annular manifold includes a first annular manifold and a second annular manifold, and the compressed air supply arrangement delivers the flow of compressed air to the first annular manifold at a first location and the second annular manifold at a second location.

16. The cross-fire tube purging arrangement of claim 15, wherein the first location is proximate the first portion of the cross-fire tube and the second location is proximate the second portion of the cross-fire tube.

17. The cross-fire tube purging arrangement of claim 12, wherein the first operating condition comprises a steady-state condition and the second operating condition comprises a light-off condition.

18. A method of purging a cross-fire tube comprising:

delivering a flow of a compressed air to the cross-fire tube during a first operating condition for purging the cross-fire tube; and restricting the flow of the compressed air to the cross-fire tube during a second operating condition, wherein delivering the flow of the compressed air to the cross-fire tube comprises flowing the compressed air through a plurality of pipes, the plurality of pipes including a first line for delivering the compressed air to a first annular manifold extending circumferentially around the cross-fire tube, a second line for delivering the compressed air to a second annular manifold extending circumferentially around the cross-fire tube, wherein restricting the flow of the compressed air is controlled with a regulating component positioned upstream of the first annular manifold and the second annular manifold.

19. The method of claim 18, wherein delivering the flow of the compressed air to the cross-fire tube comprises delivering the compressed air to the first and second annular manifolds, the first and second annular manifolds disposed proximate the cross-fire tube for injection of the compressed air into an interior region of the cross-fire tube.

20. The method of claim 18, wherein restricting the flow of the compressed air to the cross-fire tube comprises controlling the flow of the compressed air with a valve disposed in a compressed air supply arrangement.

* * * * *